US012383037B1

(12) United States Patent
Liang

(10) Patent No.: US 12,383,037 B1
(45) Date of Patent: Aug. 12, 2025

(54) CARD HOLDER WALLET

(71) Applicant: Shimin Liang, Guangzhou (CN)

(72) Inventor: Shimin Liang, Guangzhou (CN)

( * ) Notice: Subject to any disclaimer, the term of this patent is extended or adjusted under 35 U.S.C. 154(b) by 0 days.

(21) Appl. No.: 19/074,015

(22) Filed: Mar. 7, 2025

(51) Int. Cl.
*A45C 1/06* (2006.01)

(52) U.S. Cl.
CPC ..... *A45C 1/06* (2013.01); *A45C 2001/065* (2013.01)

(58) Field of Classification Search
CPC ..... A45C 1/06; A45C 2001/065
USPC ..... 150/131, 141
See application file for complete search history.

(56) References Cited

U.S. PATENT DOCUMENTS 5,121,864 A * 6/1992 Geschwind ..... A45C 13/185 383/7
7,604,028 B2 * 10/2009 Bridgefarmer ..... A45C 11/182 150/147
11,793,283 B1 * 10/2023 Zhang ..... A45C 1/06
2013/0176943 A1 * 7/2013 Chan ..... H04W 80/045 370/328
2023/0413962 A1 * 12/2023 Kane ..... A45C 13/185

* cited by examiner

*Primary Examiner* — Sue A Weaver

(57) ABSTRACT

A card holder wallet includes a first panel and a second panel. A bottom of the first panel is connected to a bottom of the second panel. Two sides of the second panel are respectively connected to the first panel through a first elastic band and a second elastic band. The first panel, the second panel, the first elastic band, and the second elastic band form the card holder wallet provided with a first opening in a top and having a first accommodating cavity, so that cards, coins, or the like can be placed into the first accommodating cavity by using the first opening, to achieve an effect of storing the cards, the coins, or the like. The first panel and the second panel are both at least partially made of flexible materials, which can make the card holder wallet thin and light.

20 Claims, 4 Drawing Sheets

CARD HOLDER WALLET

TECHNICAL FIELD

The present invention relates to the technical field of articles of daily use, in particular, to a card holder wallet.

BACKGROUND

As is well known, a card holder wallet is a storage product for storing credit cards, bank cards, coins, and the like, so that a user can carry many coins, cards, an ID card, and the like at the same time. The card holder wallet is generally formed by connecting two leather panels to form a storage space. However, the card holder wallet of this structure has great limitation on thicknesses of cards and coins that are stored in the card holder wallet, and has a large volume, so that the card holder wallet cannot adaptively store the coins and the cards according to a thickness of the coins and a quantity of the cards, thus affecting a user experience.

SUMMARY

The present invention aims to provide a card holder wallet, to solve the problems that the existing card holder wallet for storing cards or coins has a large volume and cannot be adaptively adjusted according to a quantity of cards stored and a thickness of coins stored.

In order to solve the technical problem, the technical scheme provided by the present invention is as follows.

A card holder wallet includes a first panel and a second panel. The second panel is arranged opposite to the first panel. A bottom of the first panel is connected to a bottom of the second panel.

One side or a position close to one side of the second panel is connected to the first panel through a first elastic band, and another side or a position close to another side of the second panel is connected to the first panel through a second elastic band; the first panel and the second panel are at least partially made of flexible materials; and the first panel, the second panel, the first elastic band, and the second elastic band form the card holder wallet provided with a first opening in a top and having a first accommodating cavity.

Furthermore, a width of the second panel is less than a width of the first panel; a distance between a bottom of the first elastic band and the bottom of the second panel, and a distance between a bottom of the second elastic band and the bottom of the second panel are both preset distances which are greater than 0.5 cm.

Furthermore, the first elastic band is connected to the second elastic band.

Furthermore, two ends of the first elastic band are sewn onto the first panel and the second panel respectively with sewing threads, and two ends of the second elastic band are sewn onto the first panel and the second panel respectively with sewing threads.

Furthermore, a surface of the first elastic band opposite to the second panel is bonded and fixed to the second panel, and a surface of the second elastic band opposite to the second panel is bonded and fixed to the second panel.

Furthermore, the card holder wallet further includes a flip cover connected to the first panel, the flip cover is made of a flexible material; and a free end of the flip cover is configured to be detachably fixed on the second panel to cover at least a portion of the first opening.

Furthermore, the flip cover is provided with a first magnetic attraction member; the second panel is provided with a second magnetic attraction member that is attracted to the first magnetic attraction member; and when the free end of the flip cover is fixed to the second panel, the first magnetic attraction member is attracted to the second magnetic attraction member.

Furthermore, the flip cover is formed by extending outward from the first panel.

Furthermore, a notch convenient for a user to push a card out from the first opening is provided in the bottom of the second panel, and the notch is communicated to the first accommodating cavity.

Furthermore, the notch is located at a middle position of the bottom of the second panel or a position close to the middle of the bottom of the second panel.

Furthermore, the first panel includes a first flexible layer, a first plate body, and a second flexible layer; the first plate body is located between the first flexible layer and the second flexible layer; the first plate body is sheet-like; the first plate body is made of one of plastic, metal, and a carbon fiber; the first flexible layer and the second flexible layer are made of one of leather, soft rubber, and a cloth material; and a thickness of the first plate body is 0.15 to 1 mm.

Furthermore, the first panel further includes a first buffer layer and a second buffer layer; the first buffer layer is arranged between the first flexible layer and the first plate body; the second buffer layer is arranged between the second flexible layer and the first plate body; and the first buffer layer and the second buffer layer are made of one of paper, foam, and sponge.

Furthermore, a size of the first buffer layer is substantially the same as or slightly less than a size of the first flexible layer; a size of the second buffer layer is substantially the same as or slightly less than a size of the second flexible layer; and the size of the first buffer layer and the size of the second buffer layer are both greater than a size of the first plate body.

Furthermore, the first flexible layer, the first buffer layer, the second buffer layer, and the second flexible layer are sewn and connected by sewing threads at positions close to peripheral sides, and the first flexible layer, the first buffer layer, the first plate body, the second buffer layer, and the second flexible layer are bonded and connected in sequence.

Furthermore, the second panel includes a third flexible layer and a fourth flexible layer connected to the third flexible layer; the third flexible layer and the fourth flexible layer are made of one of leather, soft rubber, and a cloth material; a bottom of the third flexible layer and/or a bottom of the fourth flexible layer is/are connected to the first panel; one end of the first elastic band is fixed to the third flexible layer or the fourth flexible layer; and one end of the second elastic band is fixed to the third flexible layer or the fourth flexible layer.

Furthermore, the second panel further includes a third buffer layer; the third buffer layer is made of one of paper, foam, and sponge; and the third buffer layer is located between the third flexible layer and the second flexible layer.

Furthermore, the third flexible layer, the third buffer layer, and the fourth flexible layer are sewn and connected by sewing threads at positions close to peripheral sides; and the third flexible layer, the third buffer layer, and the fourth flexible layer are bonded and connected in sequence.

Furthermore, the card holder wallet further includes a third panel; a peripheral side or a position close to the peripheral side of the third panel is connected to the first panel; the third panel is connected to the first panel to form a second accommodating cavity with a second opening in one side; and the third panel is located on one side of the first panel away from the second panel.

Furthermore, a window is provided in the third panel; a transparent sheet is arranged at a position of the third panel corresponding to the opening; the transparent sheet is provided with a via hole for pushing out an item in the second accommodating cavity; the via hole is communicated to the second accommodating cavity; and the third panel is made of one of leather, soft rubber, and a cloth material.

Furthermore, a position of the first panel close to one side, a position of the third panel close to one side, and one end of the first elastic band are sewn and connected through sewing threads; and a position of the first panel close to another side, a position of the third panel close to another side, and one end of the second elastic band are sewn and connected through sewing threads.

The present invention has the beneficial effects below. Compared with the prior art, the first panel, the second panel, the first elastic band, and the second elastic band form the card holder wallet provided with the first opening in the top and having the first accommodating cavity, so that cards, coins, or the like can be placed into the first accommodating cavity by using the first opening, to achieve an effect of storing the cards, the coins, or the like. Furthermore, the first panel and the second panel are both at least partially made of the flexible materials, so that the card holder wallet of this embodiment can be made light and thin. Furthermore, since the two sides of the second panel are respectively connected to the first panel through the first elastic band and the second elastic band, by using the characteristic that the first elastic band and the second elastic band can be stretched and reset, a thickness of the first accommodating cavity can be adaptively adjusted according to a quantity of cards stored and/or a thickness of coins stored. The quantity of the cards stored and/or the thickness of the coins stored in the card holder wallet are not limited by an initial volume of the card holder wallet, and the volume of the card holder wallet can be minimized, which is convenient for carrying. Furthermore, during storage of a card, the card can be limited by using tensions of the first elastic band and the second elastic band, to prevent the card from falling off from the first opening.

BRIEF DESCRIPTION OF THE DRAWINGS

In order to explain the technical solutions of the embodiments of the present invention more clearly, the following will briefly introduce the accompanying drawings used in the embodiments. Apparently, the drawings in the following description are only some embodiments of the present invention. Those of ordinary skill in the art can obtain other drawings based on these drawings without creative work.

DETAILED DESCRIPTION OF THE EMBODIMENTS

Figure 1:
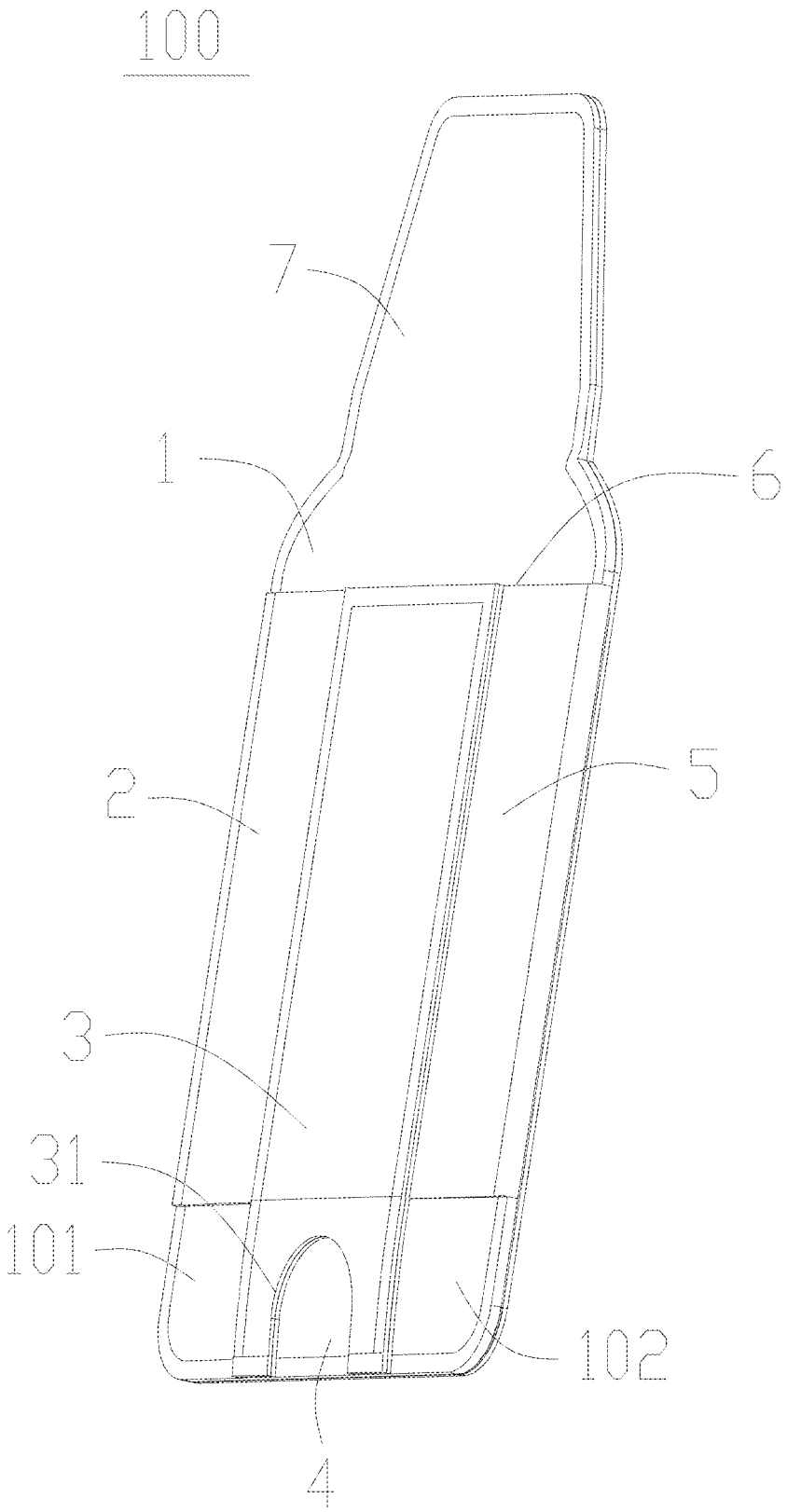
FIG. 1 is a schematic diagram of a card holder wallet with a flip cover being opened according to the present invention.
Figure 2:
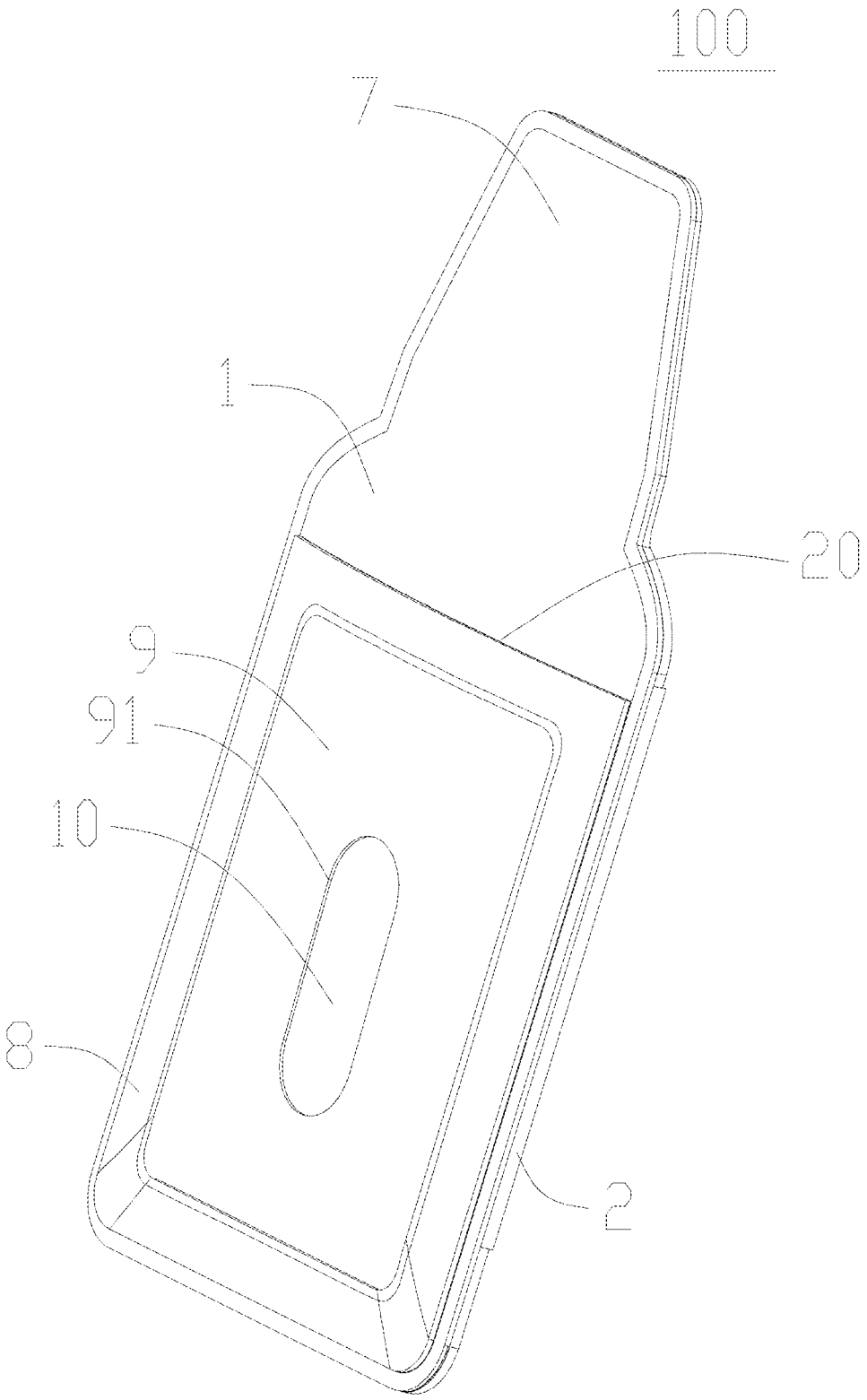
FIG. 2 is a schematic diagram of another viewing angle of a card holder wallet with a flip cover being opened according to the present invention.
Figure 3:
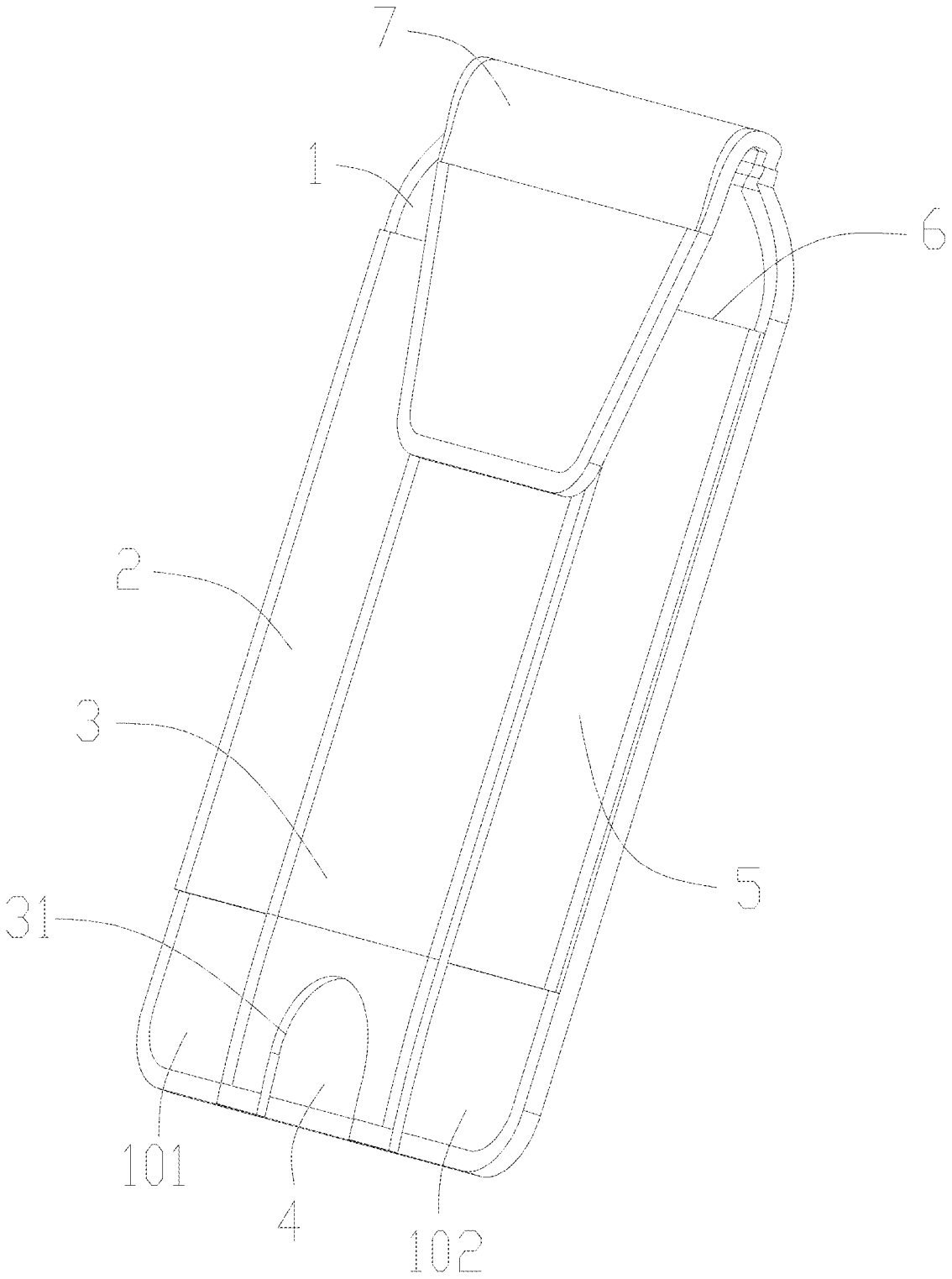
FIG. 3 is an exploded view of a card holder wallet with a flip cover according to the present invention.
Figure 4:
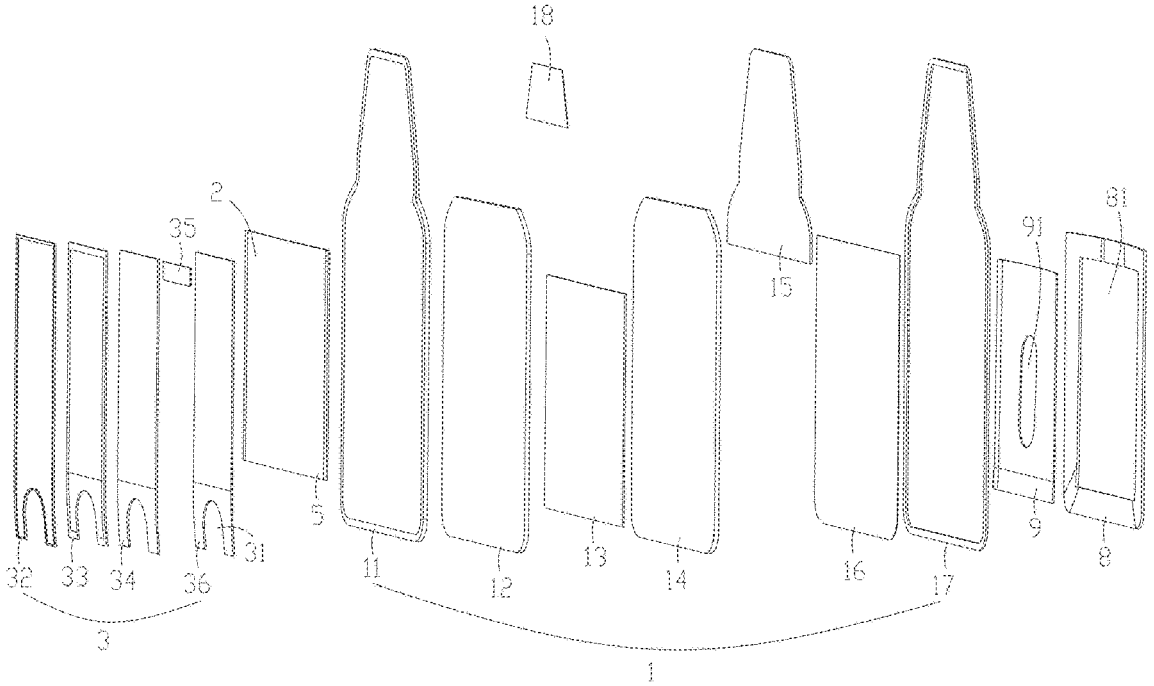
FIG. 4 is a schematic diagram of a card holder wallet with a flip cover being closed according to the present invention.

The technical solutions in the embodiments of the present invention will be clearly and completely described below in conjunction with the accompanying drawings in the embodiments of the present invention. Apparently, the described embodiments are only a part of the embodiments of the present invention, rather than all the embodiments. Based on the embodiments in the present invention, all other embodiments obtained by those ordinarily skilled in the art without doing creative work shall fall within the protection scope of the present invention.

Referring to FIG. 1 to FIG. 5, a card holder wallet 100 in an embodiment of the present invention is configured to store cards, coins, and the like.

A card holder wallet 100 includes a first panel 1 and a second panel 3. The second panel 3 is arranged opposite to the first panel 1. A bottom of the first panel 1 is connected to a bottom of the second panel 3. One side or a position close to one side of the second panel 3 is connected to the first panel 1 through a first elastic band 2, and another side or a position close to another side of the second panel 3 is connected to the first panel 1 through a second elastic band 5. The first panel 1 and the second panel 3 are at least partially made of flexible materials. The first panel 1, the second panel 3, the first elastic band 2, and the second elastic band 5 form the card holder wallet 100 provided with a first opening 6 in a top and having a first accommodating cavity 4.

In this embodiment, the first panel 1, the second panel 3, the first elastic band 2, and the second elastic band 5 form the card holder wallet 100 provided with the first opening 6 in the top and having the first accommodating cavity 4, so that cards, coins, or the like can be placed into the first accommodating cavity 4 by using the first opening 6, to achieve an effect of storing the cards, the coins, or the like. Furthermore, the first panel 1 and the second panel 3 are both at least partially made of the flexible materials, so that the card holder wallet 100 of this embodiment can be made light and thin. Furthermore, since the two sides of the second panel 3 are respectively connected to the first panel 1 through the first elastic band 2 and the second elastic band 5, by using the characteristic that the first elastic band 2 and the second elastic band 5 can be stretched and reset, a thickness of the first accommodating cavity 4 can be adaptively adjusted according to a quantity of cards stored and/or a thickness of coins stored. The quantity of the cards stored and/or the thickness of the coins stored in the card holder wallet 100 are not limited by an initial volume of the card holder wallet 100, and the volume of the card holder wallet 100 can be minimized, which is convenient for carrying. Furthermore, during storage of a card, the card can be limited by using tensions of the first elastic band 2 and the second elastic band 5, to prevent the card from falling off from the first opening 6.

In an embodiment, a width of the second panel 3 is less than a width of the first panel 1. A distance between a bottom of the first elastic band 2 and the bottom of the second panel 3, and a distance between a bottom of the second elastic band 5 and the bottom of the second panel 3 are both preset distances which are greater than 0.5 cm. Based on this structure, a bottom surface of the first elastic band 2, a side surface of the second panel 3, and a surface of the first panel 1 can be enclosed to form a second notch 101 that is communicated to the first accommodating cavity 4. A bottom surface of the second elastic band 5, a side surface of the second panel 3, and a surface of the first panel 1 can be enclosed to form a third notch 102 that is communicated to the first accommodating cavity 4. Namely, the second notch 101 and the third notch 102 are respectively located on two sides of the second panel 3 and are provided close to the bottom of the second panel 3. By using the above structure, the distance between the second panel 3 located at the bottom of the first elastic band 2 and the first panel 1 can be changed, namely, it can be convenient to adaptively coin the thickness of the first accommodating cavity 4 according to a thickness of a card or coin stored, which is convenient to store cards, coins, and the like. Certainly, in other embodiments, the preset distance L can also be 0 or less than 0.5 cm.

In an embodiment, the first elastic band 2 and the second elastic band 5 are connected. That is, it should be understood that the first elastic band 2 and the second elastic band 5 are continuous elastic bands. By using the second panel 3, an elastic band is cut and defined as the first elastic band 2 and the second elastic band 5. Through this structure, it can be convenient to fix the elastic bands and the second panel, 3 to reduce procedures of production of the card holder wallet 100 because of the first elastic band 2 and the second elastic band 5 that are discontinuous. Furthermore, the first elastic band 2 and the second elastic band 5 are a continuous elastic band. When both the first elastic band 2 and the second elastic band 5 are located on one side of the second panel 3 close to the first panel 1, resistance to placing a card or a coin in the first accommodating cavity 4 can be reduced, so that it is convenient to store the card into the first accommodating cavity 4. Certainly, in other embodiments, the first elastic band 2 and the second elastic band 5 can also be discontinuous elastic bands.

In an embodiment, two ends of the first elastic band 2 are sewn onto the first panel 1 and the second panel 3 respectively with sewing threads, and two ends of the second elastic band 5 are sewn onto the first panel 1 and the second panel 3 respectively with sewing threads, so that the two ends of the first elastic band 2 and the two ends of the second elastic band 5 are respectively fixed on the first panel 1 and the second panel 3. Certainly, in other embodiments, the two ends of the first elastic band 2 and the two ends of the second elastic band 5 can also be fixed to the first panel 1 and the second panel 3 in a bonded manner by glue.

In an embodiment, a surface of the first elastic band 2 opposite to the second panel 3 is bonded and fixed to the second panel 3, and a surface of the second elastic band 5 opposite to the second panel 3 is bonded and fixed to the second panel 3, so that a connection structure between the second panel 3 and the first elastic band 2 and a connection structure between the second panel 3 and the second elastic band 5 are more stable, and the card holder wallet has a more compact structure. Furthermore, the two ends of the first elastic band 2 are sewn onto the first panel 1 and the second panel 3 respectively with the sewing threads and the two ends of the second elastic band 5 are sewn onto the first panel 1 and the second panel 3 respectively with the sewing threads, so that reliability of connection between the second panel 3 and the first elastic band 2, as well as the second elastic band 5, can be effectively improved.

In an embodiment, the card holder wallet 100 further includes a flip cover 7 connected to the first panel 1, and the flip cover 7 is made of a flexible material. A free end of the flip cover 7 is configured to be detachably fixed on the second panel 3 to cover at least a portion of the first opening 6. The flip cover 7 can effectively prevent a card from falling off from the first opening 6 when the card is stored into the card holder wallet 100.

In an embodiment, the flip cover 7 is provided with a first magnetic attraction member 18. The second panel 3 is provided with a second magnetic attraction member 35 that is attracted to the first magnetic attraction member 18. When the free end of the flip cover 7 is fixed to the second panel 3, the first magnetic attraction member 18 is attracted to the second magnetic attraction member 35, so as to achieve detachable connection between the free end of the flip cover 7 and the second panel 3. Certainly, in other embodiments, the free end of the flip cover 7 can also be detachably connected to the second panel 3 in a manner such as a hook and loop fastener, a button, a hasp, and a buckle.

In an embodiment, the flip cover 7 is formed by extending outward from the first panel 1, namely, the flip cover 7 and the first panel 1 are of an integrated structure for ease of production and manufacturing of the product.

In other embodiments, the flip cover 7 can also be connected to the second panel 3, and the free end of the flip cover 7 is detachably connected to the first panel 1, which can also cover at least a portion of the first opening 6.

In an embodiment, a first notch 31 convenient for a user to push a card out from the first opening 6 is provided in the bottom of the second panel 3, and the first notch 31 is communicated to the first accommodating cavity 4, so that it is convenient for the user to take out the card.

In an embodiment, the first notch 31 is located at a middle position of the bottom of the second panel 3 or a position close to the middle of the bottom of the second panel 3. Namely, by using the first notch 31 at this position, the card can be pushed from a middle position of a bottom of the card, which achieves effective pushing of the card. Certainly, in other embodiments, the first notch 31 can also be located at a position far away from the middle of the bottom of the second panel 3.

In an embodiment, the first panel 1 includes a first flexible layer 11, a first plate body 13, and a second flexible layer 16. The first plate body 13 is located between the first flexible layer 11 and the second flexible layer 16. The first plate body 13 is sheet-like. The first plate body 13 can be made of plastic, metal, a carbon fiber, and the like. The first flexible layer 11 and the second flexible layer 16 are made of leather, soft rubber, a cloth material, and the like. A thickness of the first plate body 13 is 0.15 to 1 mm. By using the first flexible layer 11 and the second flexible layer 16, a hand feel on the first panel 1 can be soft. In addition, by using the first plate body 13, hardness of the first panel 1 can be increased, making the first panel 1 more flexible to cooperate with the first accommodating cavity 4 formed by the second panel 3. It is convenient to insert a card or a coin into or remove a card or a coin from the first accommodating cavity 4.

The first elastic band 2 and the second elastic band 5 are both arranged between the first flexible layer 11 and the second flexible layer 16 at one end away from the second panel 3, and are sewn and fixed through sewing threads.

In an embodiment, the first panel 1 further includes a first buffer layer 12 and a second buffer layer 14. The first buffer layer 12 is arranged between the first flexible layer 11 and the first plate body 13. The second buffer layer 14 is arranged between the second flexible layer 16 and the first plate body 13. The first buffer layer 12 and the second buffer layer 14 can be made of paper, foam, sponge, and the like. By using the first buffer layer 12 and the second buffer layer 14, the hand feel of use of the first panel 1 can be further enhanced. By using the first buffer layer 12 and the second buffer layer 14 to separate the first plate body 13 from the first flexible layer 11 and the second flexible layer 16 respectively, the first plate body 13 can be prevented from directly rubbing against the first flexible layer 11 and the second flexible layer 16, to prevent damage to the first panel 1 and prolong the service life of the first panel 1.

In one embodiment, a size of the first buffer layer 12 is substantially the same as or slightly less than a size of the first flexible layer 11. A size of the second buffer layer 14 is substantially the same as or slightly less than a size of the second flexible layer 16. The size of the first buffer layer 12 and the size of the second buffer layer 14 are both greater than a size of the first plate body 13. When the first plate body 13 is arranged between the first buffer layer 12 and the second buffer layer 14, the first plate body 13 can be completely wrapped around, to effectively prevent the first plate body 13 from being in contact with the first flexible layer 11 and the second flexible layer 16 and improve the structural compactness and service life of the first panel 1.

The first flexible layer 11, the first buffer layer 12, the second buffer layer 14, and the second flexible layer 16 are connected by sewing threads at positions close to peripheral sides, to fixedly connect the first flexible layer 11, the first buffer layer 12, the second buffer layer 14, and the second flexible layer 16 to the first plate body 13.

In an embodiment, the first flexible layer 11, the first buffer layer 12, the first plate body 13, the second buffer layer 14, and the second flexible layer 16 are bonded and connected in sequence, to effectively improve the structural compactness of the first panel 1.

In the embodiments with the flip cover 7, the flip cover 7 can be formed by extending from the first flexible layer 11, or the flip cover 7 can be formed by extending from the first flexible layer 11 and being sewn together with another flexible layer.

In an embodiment, the second panel 3 includes a third flexible layer 33 and a fourth flexible layer 36 connected to the third flexible layer 33. The third flexible layer 33 and the fourth flexible layer 36 are made of leather, soft rubber, a cloth material, and the like. A bottom of the third flexible layer 33 and/or a bottom of the fourth flexible layer 36 is/are connected to the first panel 1. One end of the first elastic band 2 is fixed to the third flexible layer 33 or the fourth flexible layer 36. One end of the second elastic band 5 is fixed to the third flexible layer 33 or the fourth flexible layer 36. By using the third flexible layer 33 and the fourth flexible layer 36, a hand feel on the second panel 3 can be soft. In addition, when an item is stored into the first accommodating cavity 4, the first elastic band 2 and the second elastic band 5 can be used to change the size of the first accommodating cavity 4, for ease of storage of the item.

In an embodiment, the second panel 3 further includes a third buffer layer 34. The third buffer layer 34 is made of one of paper, foam, and sponge. The third buffer layer 34 is located between the third flexible layer 33 and the second flexible layer 16. By using the first buffer layer 12 and the second buffer layer 14, the hand feel of use of the first panel 1 can be further enhanced. Furthermore, the flexibility of the second panel 3 can be improved, and the service life and structural compactness of the second panel 3 can be improved.

The third flexible layer 33, the third buffer layer 34, and the fourth flexible layer 36 are connected at positions close to peripheral sides through sewing threads, to achieve production and manufacturing of the second panel 3.

In an embodiment, the third flexible layer 33, the third buffer layer 34, and the fourth flexible layer 36 are bonded and connected in sequence, which can make the structure of the second panel 3 more compact. The third flexible layer 33, the third buffer layer 34, and the fourth flexible layer 36 are sewn and connected at the positions close to the peripheral sides through the sewing threads, so that reliability of connection between the third flexible layer 33, the third buffer layer 34, and the fourth flexible layer 36 is effectively improved.

In an embodiment, the card holder wallet 100 further includes a third panel 8. A peripheral side or a position close to the peripheral side of the third panel 8 is connected to the first panel 1. The third panel 8 is connected to the first panel 1 to form a second accommodating cavity 10 with a second opening 20 in one side. The third panel 8 is located on one side of the first panel 1 away from the second panel 3. Through the second opening 20, it is convenient for a user to insert a card into the second accommodating cavity 10, which can enlarge a space for storing items in conjunction with the first accommodating cavity 4.

In an embodiment, a window 81 is provided in the third panel 8. A transparent sheet 9 is arranged at a position of the third panel 8 corresponding to the opening. By using the window 81, it is convenient for a user to view information of an item in the second accommodating cavity 10. In conjunction with the transparent sheet 9, the second accommodating cavity 10 can be used to stably store the item and protect the stored item. By using this structure, it is convenient for a user to store an ID card, a business card, a bank card, and the like, and to view information on the ID card, the business card, and another item, which facilitates use.

In an embodiment, the transparent sheet 9 is provided with a via hole 91 for pushing out an item in the second accommodating cavity 10. The via hole 91 is communicated to the second accommodating cavity 10. The third panel 8 is made of leather, soft rubber, a cloth material, and the like. By using the via hole 91, it is convenient for a user to touch the item inside the second accommodating cavity 10 and push the item out.

In an embodiment, a position of the first panel 1 close to one side, a position of the third panel 8 close to one side, and one end of the first elastic band 2 are connected through sewing threads. Namely, the first panel 1, the third panel 8, and the first elastic band 2 are sewn and connected through the sewing threads. A position of the first panel 1 close to another side, a position of the third panel 8 close to another side, and one end of the second elastic band 5 are sewn and connected through sewing threads. Namely, the first panel 1, the third panel 8, and the second elastic band 5 are sewn and connected together through the sewing threads, to facilitate production and manufacturing of the card holder wallet 100 of this embodiment.

In an embodiment, a first paint edge 17 is arranged on the peripheral side of the first panel 1. The first paint edge 17 covers at least side walls of both the first flexible layer 11 and the second flexible layer 16, as well as a gap between the first flexible layer 11 and the second flexible layer 16. A second paint edge 32 is arranged on the peripheral side of the second panel 3. The second paint edge 32 covers at least side walls of both the third flexible layer 33 and the fourth flexible layer 36, as well as a gap between the third flexible layer 33 and the fourth flexible layer 36, to beautify the appearance of the card holder wallet 100.

In an embodiment, a length of the first accommodating cavity 4 on a horizontal axis is less than a length of the first accommodating cavity 4 on a vertical axis, so as to configure the first accommodating cavity 4 to vertically store a card, as shown in FIG. 1 to FIG. 4.

Figure 5:
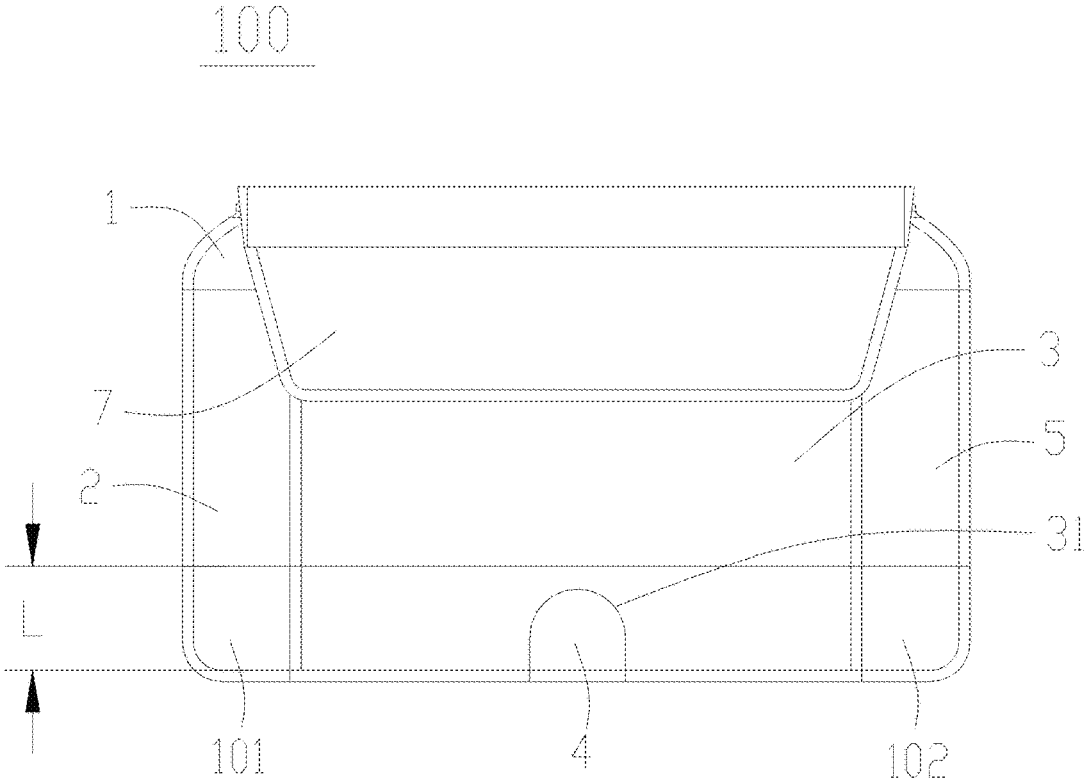
FIG. 5 is a schematic diagram of a card holder wallet that transversely storing a card according to the present invention.

In an embodiment, a length of the first accommodating cavity 4 on a vertical axis is less than a length of the first accommodating cavity 4 on a horizontal axis, so as to configure the first accommodating cavity 4 to transversely store a card, as shown in FIG. 5.

It should be noted that all directional indications (such as up, down, left, right, front, back . . . ) in the embodiments of the present invention are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present invention are only used for descriptive purposes, and cannot be understood as indicating or implying its relative importance or implicitly indicating the number of technical features indicated. Therefore, features defined by "first" and "second" can explicitly instruct or impliedly include at least one feature. In addition, "and/or" in the entire text includes three solutions. A and/or B is taken as an example, including technical solution A, technical solution B, and technical solutions that both A and B satisfy. In addition, the technical solutions between the various embodiments can be combined with each other, but it needs be based on what can be achieved by those of ordinary skill in the art. When the combination of the technical solutions is contradictory or cannot be achieved, it should be considered that such a combination of the technical solutions does not exist, and is not within the scope of protection claimed by the present invention.

The above descriptions are only preferred embodiments of the present invention, and are not intended to limit the patent scope of the present invention. Any equivalent structural transformation made by using the content of the specification and the drawings of the present invention under the invention idea of the present invention, directly or indirectly applied to other related technical fields, shall all be included in the scope of patent protection of the present invention.

What is claimed is:

1. A card holder wallet, comprising a first panel and a second panel, wherein the second panel is arranged opposite to the first panel; a bottom of the first panel is connected to a bottom of the second panel;

one side or a position close to one side of the second panel is connected to the first panel through a first elastic band, and another side or a position close to another side of the second panel is connected to the first panel through a second elastic band; the first panel and the second panel are at least partially made of flexible materials; and the first panel, the second panel, the first elastic band, and the second elastic band form the card holder wallet provided with a first opening in a top and having a first accommodating cavity.

2. The card holder wallet according to claim 1, wherein a width of the second panel is less than a width of the first panel; a distance between a bottom of the first elastic band and the bottom of the second panel, and a distance between a bottom of the second elastic band and the bottom of the second panel are both preset distances which are greater than 0.5 cm.

3. The card holder wallet according to claim 1, wherein the first elastic band is connected to the second elastic band.

4. The card holder wallet according to claim 1, wherein two ends of the first elastic band are sewn onto the first panel and the second panel respectively with sewing threads, and two ends of the second elastic band are sewn onto the first panel and the second panel respectively with sewing threads.

5. The card holder wallet according to claim 4, wherein a surface of the first elastic band opposite to the second panel is bonded and fixed to the second panel, and a surface of the second elastic band opposite to the second panel is bonded and fixed to the second panel.

6. The card holder wallet according to claim 1, further comprising a flip cover connected to the first panel, wherein the flip cover is made of a flexible material; and a free end of the flip cover is configured to be detachably fixed on the second panel to cover at least a portion of the first opening.

7. The card holder wallet according to claim 6, wherein the flip cover is provided with a first magnetic attraction member; the second panel is provided with a second magnetic attraction member that is attracted to the first magnetic attraction member; and when the free end of the flip cover is fixed to the second panel, the first magnetic attraction member is attracted to the second magnetic attraction member.

8. The card holder wallet according to claim 6, wherein the flip cover is formed by extending outward from the first panel.

9. The card holder wallet according to claim 1, wherein a notch convenient for a user to push a card out from the first opening is provided in the bottom of the second panel, and the notch is communicated to the first accommodating cavity.

10. The card holder wallet according to claim 9, wherein the notch is located at a middle position of the bottom of the second panel or a position close to the middle of the bottom of the second panel.

11. The card holder wallet according to claim 1, wherein the first panel comprises a first flexible layer, a first plate body, and a second flexible layer; the first plate body is located between the first flexible layer and the second flexible layer; the first plate body is sheet-like; the first plate body is made of one of plastic, metal, and a carbon fiber; the first flexible layer and the second flexible layer are made of one of leather, soft rubber, and a cloth material; and a thickness of the first plate body is 0.15 to 1 mm.

12. The card holder wallet according to claim 11, wherein the first panel further comprises a first buffer layer and a second buffer layer; the first buffer layer is arranged between the first flexible layer and the first plate body; the second buffer layer is arranged between the second flexible layer and the first plate body; and the first buffer layer and the second buffer layer are made of one of paper, foam, and sponge.

13. The card holder wallet according to claim 12, wherein a size of the first buffer layer is substantially the same as or slightly less than a size of the first flexible layer; a size of the second buffer layer is substantially the same as or slightly less than a size of the second flexible layer; and the size of the first buffer layer and the size of the second buffer layer are both greater than a size of the first plate body.

14. The card holder wallet according to claim 12, wherein the first flexible layer, the first buffer layer, the second buffer layer, and the second flexible layer are sewn and connected by sewing threads at positions close to peripheral sides, and the first flexible layer, the first buffer layer, the first plate body, the second buffer layer, and the second flexible layer are bonded and connected in sequence.

15. The card holder wallet according to claim 1, wherein the second panel comprises a first flexible layer and a second flexible layer connected to the first flexible layer; the first flexible layer and the second flexible layer are made of one of leather, soft rubber, and a cloth material; a bottom of the first flexible layer and/or a bottom of the second flexible layer is/are connected to the first panel; one end of the first elastic band is fixed to the first flexible layer or the second flexible layer; and one end of the second elastic band is fixed to the first flexible layer or the second flexible layer.

16. The card holder wallet according to claim 15, wherein the second panel further comprises a buffer layer; the third buffer layer is made of one of paper, foam, and sponge; and the buffer layer is located between the first flexible layer and the second flexible layer.

17. The card holder wallet according to claim 16, wherein the first flexible layer, the buffer layer, and the second flexible layer are sewn and connected by sewing threads at positions close to peripheral sides; and the first flexible layer, the buffer layer, and the second flexible layer are bonded and connected in sequence.

18. The card holder wallet according to claim 1, further comprising a third panel; a peripheral side or a position close to the peripheral side of the third panel is connected to the first panel; the third panel is connected to the first panel to form a second accommodating cavity with a second opening in one side; and the third panel is located on one side of the first panel away from the second panel.

19. The card holder wallet according to claim 18, wherein a window is provided in the third panel; a transparent sheet is arranged at a position of the third panel corresponding to the opening; the transparent sheet is provided with a via hole for pushing out an item in the second accommodating cavity; the via hole is communicated to the second accommodating cavity; and the third panel is made of one of leather, soft rubber, and a cloth material.

20. The card holder wallet according to claim 18, wherein a position of the first panel close to one side, a position of the third panel close to one side, and one end of the first elastic band are sewn and connected through sewing threads; and a position of the first panel close to another side, a position of the third panel close to another side, and one end of the second elastic band are sewn and connected through sewing threads.

* * * * *